US005465784A

United States Patent [19]

Blangetti et al.

[11] Patent Number: 5,465,784

[45] Date of Patent: Nov. 14, 1995

[54] STEAM CONDENSER

[75] Inventors: Francisco Blangetti, Baden; Andreas Kost, Herznach, both of Switzerland; Gunter Volks, Lauchringen, Germany

[73] Assignee: ABB Management AG, Baden, Switzerland

[21] Appl. No.: 222,918

[22] Filed: Apr. 5, 1994

[30] Foreign Application Priority Data

Apr. 5, 1993 [DE] Germany ..... 43 11 118.1

[51] Int. Cl.[6] ..... F28B 9/10

[52] U.S. Cl. ..... 165/114; 165/111

[58] Field of Search ..... 165/111, 114

[56] References Cited

U.S. PATENT DOCUMENTS 2,224,877 12/1940 McNulty .
4,461,346 7/1984 Hoshino et al. ..... 165/114

FOREIGN PATENT DOCUMENTS 423819 5/1967 Germany .
1948073 3/1971 Germany .
505357 5/1971 Germany .

*Primary Examiner*—Allen J. Flanigan
*Attorney, Agent, or Firm*—Oblon, Spivak, McClelland, Maier, & Neustadt

[57] ABSTRACT

A steam condenser wherein the steam is precipitated on tubes (13), through which cooling water flows and which are gathered into separate bundles. Each bundle is divided into compartments by support plates, the support plates being arranged perpendicularly to the tubes. The tubes, which are arranged in rows and form a bundle, envelop a cavity (19), in which a cooler (3) is disposed for the non-condensible gases. The non-condensible gases flow from the cooler (3) via orifices (6) into a suction channel (4), which is common to all compartments and extends over the entire length of the tubes (13). There is only one cooler (3), to which the suction channel (4) is directly attached, and the passage areas of the orifices (6) in the compartments are dimensioned in such a manner that the local, non-condensible mass flow is withdrawn with the locally available pressure difference.

3 Claims, 1 Drawing Sheet

STEAM CONDENSER

FIELD OF THE INVENTION

The invention relates to a steam condenser, in which the steam is precipitated on tubes, through which cooling water flows and which are gathered into separate bundles, wherein each bundle is divided into compartments by means of support plates arranged perpendicularly to the tubes, wherein the tubes, which are arranged in rows and belong to a bundle, envelop a cavity, in which a cooler is disposed for the non-condensible gases and, wherein the non-condensible gases flow from the cooler by way of orifices into a suction channel, which is common to all compartments and extends over the entire length of the tubes.

STATE OF THE ART

A steam condenser is known from CH-PS 423 819 and DE-OS 1 948 073 (corresponding to GB 1299639). There the condenser tubes are arranged in multiple, so-called partial bundles in a condenser housing. The steam flows through an exhaust steam tube into the condenser housing and is divided in the space by means of the flow gases (steam entry lanes). The free inflow of the steam to the external tubes of the partial bundles is maintained. Then the steam flows through the bundles with small resistance owing to the negligible depth of the rows of tubes. To fulfill the condition of the steam velocity that is to be maintained adequately high in the inflow channels, the partial bundles are arranged in such a manner side-by-side in the condenser that between them flow channels are produced that look like the partial bundles themselves in a sectional drawing of the same order to magnitude. Moreover, the tubes form in the successive rows a permeable surround, which preferably presents throughout an identical hydraulic resistance.

This known condenser exhibits the advantage that all of the peripheral tubes of a partial bundle are well charged with steam without noticeable pressure loss on account of the loose arrangement. On the other hand, the demand for at least approximately identical "wall thickness", respectively resistance, of the partial bundle of tubes around the cavity requires a relatively tall total height of the partial bundle. The result is the outstanding suitability of this partial bundle idea for large condensers, in which a plurality of partial bundles are arranged side-by-side.

The condensers working in a vacuum require a well functioning suction system, so that incident, non-condensible gases are always removed from the area of condensation. Cooling tubes, which are enveloped by or around which gases, mixed with steam flow, are almost totally lost as the condensing surface, a state that reduces the capacity.

In addition, the vacuum cannot be maintained at the lowest possible value owing to the incident gases. As well-known, non-condensible gases—usually air—cause in concentrations of 1% mole ratio, at temperature differences between wall and steam nucleus of 4–5K, a reduction of the heat transmission on the steam side—for semi-resting steam—to 30–40% of that value that can be obtained with pure steam. Thus, the vacuum loss is expressed in a lower efficiency of the circulation system.

In the aforementioned solution according to DE-OS 1 948 073 an inflow system of tubes was designed. The partial bundles are divided into compartments by means of the support plates arranged perpendicularly to the tubes. As well-known, the condensing capacity along the cooling tubes depends primarily on the local temperature difference between steam and cooling water. Then the condensing power of the first compartments on the inlet side for cooling water will condense more than that of the compartments on the outlet side for cooling water. Thus, non-condensible gases will be produced more—in proportion to the condensing power—in the "cooler" compartments. To account for this, the inert gas-area of concentration is designed as two parts in the condenser according to the DE-OS 1 948 073, which will be described below in detail with respect to FIG. 1. Said area comprises a funnel-shaped "pre-air cooler", referred to therein as an after condensing element, and an encapsulated air cooler, which communicates with the pre-air cooler and a subsequent suction channel (header) by way of a double row of uniformly distributed cooler inlet orifices, respectively cooler outlet orifices. This encapsulated air cooler is designed geometrically in such a manner that the deterioration of the heat transmission on the steam side is compensated partially by an increase in the velocity of the gas phase. Since the encapsulated air cooler adapts to the approximate temperature gradient of the cooling water in the adjacent tubes, said air cooler guarantees a suitable ventilation of the pre-air cooler proportional to the resulting non-condensible gases.

Such an encapsulated air cooler construction does not represent in the meantime an ideal solution for the different ventilation requirements in the different compartments. Since the outlet area from the air cooler is usually too large for uniform suction, an end plate, in which the aforementioned cooler outlet orifices are arranged, is arranged between the air cooler and the suction channel. Thus, the system comprises several channels and can be designed only as an expensive sheet metal and welding assembly.

SUMMARY OF THE INVENTION

Therefore, the invention is based on the problem of providing a condenser of the aforementioned kind that is characterized by low production costs while maintaining the known advantages of the partial bundle idea.

This problem is solved according to the invention by providing only one cooler, to which the suction channel is directly attached, and by dimensioning the passage areas of the orifices in the compartments in such a manner that the local, non-condensible mass flow is withdrawn with the locally available pressure difference.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

In the figures the identical parts are provided with the same reference numerals, but wherein the elements belonging only to state of the art are provided with the subscript s.

DESCRIPTION OF THE PREFERRED EMBODIMENT

The illustrated heat exchanger is a surface condenser, which exhibits a rectangular shape and is suitable as a so-called underfloor arrangement. Those parts that are essential to the invention such as condenser neck, condenser chamber, condenser shell, water chambers, tube bottoms, condensate tank, etc. are omitted, but are explained briefly in the following description of the invention.

Figure 1:
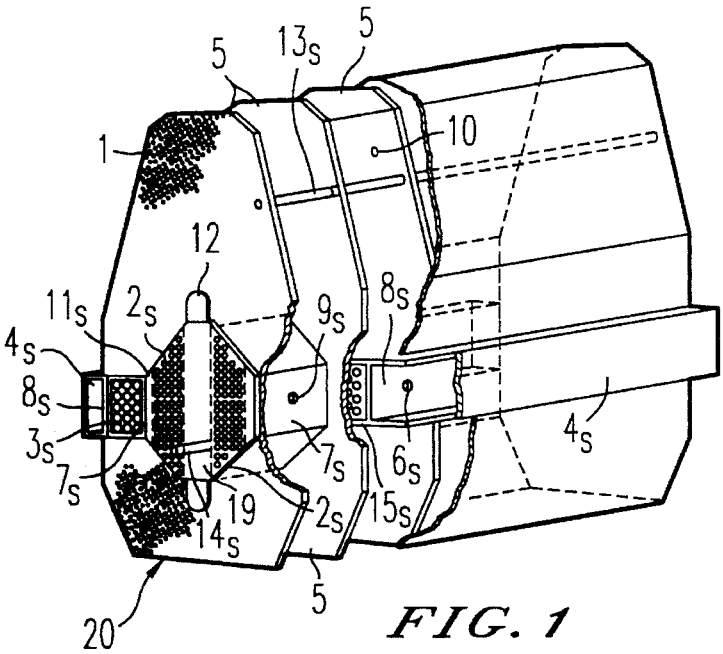
FIG. 1 is an oblique view of a partial bundle of a condenser, whose parts are partially broken out, with an air cooler belonging to the start of the art.

The steam flows into the condenser neck via an exhaust steam tube, to which the condenser is attached at the turbine. In said neck a flow field is produced that is as homogeneous as possible in order to rinse clean the downstream bundle 20 over its entire length. The condensing chamber in the interior of the condenser shell contains several bundles arranged side-by-side. The object is, among other things, that the cooling water side can be partially shut off even when the system is in service, for example, for the purpose of inspecting a turned off bundle on the cooling water side. The independent admission of cooling water expresses itself through the division of the water chambers of the condenser by means of the partitions into compartments. A bundle 20 comprises a number of tubes, of which FIG. 1 shows only one cooling tube denoted as 13*s*. The cooling tubes in the tube bottoms are attached at both ends. Beyond the tube bottoms the water chambers are arranged. The condensate draining from the bundles is collected in a condensate tank and flows from there into the water/steam circulation.

The bundles 20 are designed in such a manner that sufficient steam flows against all tubes 13*s* of the periphery without noticeable pressure loss. To guarantee a homogeneous, clean steam flow and in particular to preclude within the bundle, the existing flow lanes between the bundles, on the one hand, and between the outer bundles and their adjacent condenser wall are designed to match.

In FIG. 1 the condensing element of the bundle 20, which is only partially illustrated by means of the dotted area, is denoted as 1. Installation of the continuous support plates 5, which serve to brace the cooling tubes 13, results in a division of the partial bundles into compartments 10.

A cavity 19, in which the steam enriched with non-condensible gases—called air hereinafter—collects, is designed in the interior of each bundle 2. An air cooler is housed in this cavity 19. The mixture of steam and air flows through this air cooler, whereby the bulk of the steam condenses. The rest of the mixture is withdrawn at the cold end. The air cooler, located in the interior of the tube bundle, has the effect that the mixture of steam and gas is accelerated within the condenser bundle. Thus, the conditions are improved insofar as no small flow rates prevail that could have a negative impact on the heat transmission.

As another measure that serves to admit steam uniformly into the bundle, the air cooler is arranged on that level within the bundle on which on both sides of the bundles the pressure gradient in the steam entry lane passes through a relative minimum. In the example shown in FIG. 1 the air cooler is thus in the center of the bundle. The bundle is designed in such a manner that the steam drawn into the cavity 19 acts—taking into consideration the effective pressure at the tube periphery and owing to the different widths of the tube rows—homogeneously in the radial direction over all of the tubes bordering the cavity 19. The result is a homogeneous pressure gradient and thus a clear flow direction of the steam and the non-condensible gases in the direction of the air cooler. The cavity 19 exhibits upstream a compensating lane 12, which is within the bundle and which provides that the steam, enriched with air, also finds from the core of the front half of the bundle a frictionless path to the air cooler.

In service the steam condenses at the tubes 13 and the condensate drips in the direction of the condenser bottom. This dripping action takes place within the bundles, whereby the condensate makes contact with steam of increasing pressure.

The air cooler has the task of removing the non-condensible gases from the condenser. During this operation the steam losses are held as low as possible. Thus, it is achieved that the steam/air mixture is accelerated in the direction of the suction channel. The high velocity results in good heat transmission, a feature that leads to extensive condensation of the residual steam. For the purpose of accelerating the mixture, the cross section in the flow direction is dimensioned so as to become continuously smaller.

FIG. 1 shows the aforementioned cooling system known from the DE-OS 1 948 073. It comprises the precooler 2*s*, of which the cooling tube 14*s* is depicted, and the encapsulated air cooler 3*s*, of which the cooling tube 15*s* is depicted. Between both there is a chamber 11*s* for pressure compensation. This non-tubed space 11*s* is necessary primarily for welding the sheet metal wall 7*s*, separating the air cooler 3*s* from the precooler 2*s*, to the support plates 5. The orifices 9*s* are arranged in the sheet metal wall 7*s*. The sheet metal wall 8*s* provided at the outlet of the cooler 3*s* also has orifices 6*s*, by way of which the non-condensible gases are drawn off into the suction chamber 4*s*. With the installation of these throttling points the goal of reducing the pressure difference, which is necessary in any case, at the beginning and end of the condensing operation primarily in the orifices is achieved.

In the meantime reaching controlled flow conditions in the closed air cooler 3*s* with the aid of the two-fold orifice system is not uncomplicated. In some circumstances the flow-promoting partitions still have to be installed into the air cooler, as FIGS. 2 and 3 of the DE-OS 1 948 073 show. A subsequent modification of the orifices 9*s* is no longer possible on account of the inaccessibility due to the tubing and the optional partitions in the cooler 3*s*. In addition, as a consequence of the inadequate acceleration of the mixture in the precooler 2*s* in the direction of the air cooler 3*s* the result is $NH_3$ corrosion phenomena in the compensation chamber 11*s*. Depending on the arrangement of the orifices 6*s* it can also be necessary to have to drain the air cooler 3*s*. It is also evident from the two aforementioned FIGS. 2 and 3 of the DE-OS 1 948 073 that the tubes within the air cooler do not lie on the same network as the tubes of the precooler and the condensing area. The results are significant drawbacks when the support plates 5 are machined on numerically controlled machines.

The present invention has, as its object, the function of eliminating all of these drawbacks by avoiding the encapsulated cooler. According to FIG. 2, the cooling tubes 15 of the cooler 3 are arranged in the shape of a funnel. The funnel walls 16, which compartmentalize the cooler 3 from the condensing chamber 1, are connected together at an acute angle and longitudinally extend parallel to the tubes. The upper section has the funnel walls 16 with the cover plate 17, which is slid over the tubes of the cooler in the direction of the cavity 19 and protects said tubes from the flow of steam and condensate flowing from the top to the bottom. Thus, the flow direction of the mixture to be cooled is also predetermined, namely from the rear cavity to the front in the direction of the tip of the funnel. In the region of its connection these funnel walls form simultaneously the partition 7 to the suction channel 4. This partition 7 has orifices 6 in the immediate region of the funnel tip. It is apparent from FIG. 2 that the following advantages are associated with this configuration. First, the mixture to be subsequently condensed is accelerated increasingly up to the orifice inlet. Secondly, it is clear that only one row of tubes has to remain untubed in order to weld the funnel to the support plates.

The non-condensible gases are withdrawn via the orifices into the channel 4, from which they issue from the condenser in the longitudinal direction. The suction line 4 penetrates in this case one of the non-illustrated tube bottoms and the corresponding water chamber.

These orifices 6, which are attached in the region of the last point of the funnel, represent the physical separation between the condensing chamber 1 and the suction channel 4. Said orifices are distributed repeatedly over the entire tube length of the condenser and bring about, due to the generation of a pressure loss, the suction effect that is homogeneous in all compartments 10 of the condenser. In addition, their passage area must be dimensioned in such a manner that the varying distribution of pressure in the compartments along the length of the condenser is taken into account. The cross sectional demand that varies per compartment can be met by suitably arranging a plurality of boreholes with different diameters and/or different spacing. The orifice diameter and orifice distance must be selected in such a manner that the local, non-condensible mass flow is withdrawn with the locally available pressure difference.

Figure 2:
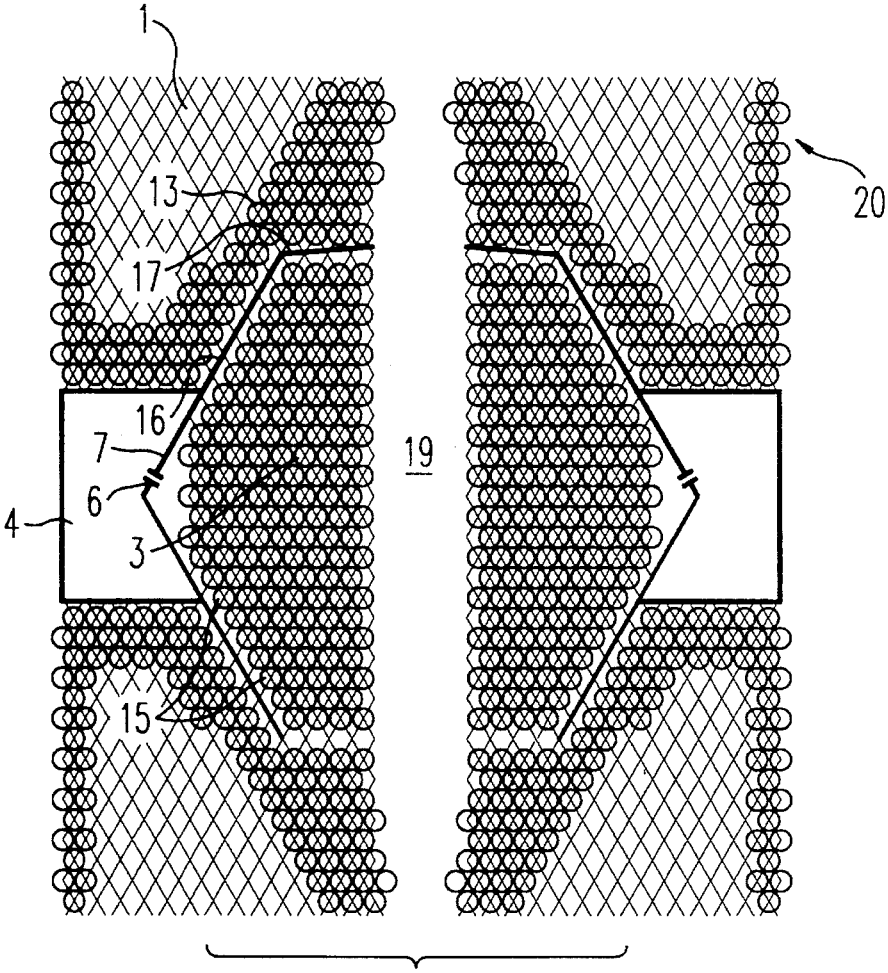
FIG. 2 is an enlarged view of the design of the air cooler according to the invention.

Compared to the solution belonging to the state of the art it is obvious from FIG. 2 that, first of all, one can make do with a significantly lower sheet metal requirement and consequently less welding work; and secondly it is possible to modify at a later date the orifices 6 by simply removing the rear wall of the suction channel 4.

What is claimed as new and desired to be secured by Letters Patent of the United States is:

1. A steam condenser, which comprises: a plurality of tubes on which steam is precipitated and through which cooling water flows wherein said tubes are gathered into separate bundles, each of said bundles including support plates which divide each of said bundles into compartments wherein said support plates are arranged perpendicularly to the tubes and the tubes are arranged in rows in each of said bundles and said tubes enveloping a cavity;

a cooler comprising a plurality of tubes compartmentalized by walls from the condenser, said cooler being disposed in said cavity for non-condensible gases and having orifices formed therein, said cooler having an open portion facing said cavity; and at least one suction channel common to each of the compartments wherein the non-condensible gases flow from the cooler via the orifices to the suction channel and wherein the suction channel extends the entire length of the tubes wherein the suction channel is directly attached to the walls of the cooler and wherein the cooler has orifices dimensioned in such a manner that a local, non-condensible mass flow is withdrawn from the cooler due to locally available pressure difference.

2. The steam condenser as claimed in claim 1, wherein the cooler has tubes arranged in the shape of a funnel, said walls of the cooler longitudinally extend parallel to the tubes and wherein said orifices are formed in said walls of said funnel.

3. The steam condenser as claimed in claim 1, wherein the at least one suction channel comprises a pair of suction channels.

* * * * *